US011204194B2

(12) United States Patent
Kim et al.

(10) Patent No.: US 11,204,194 B2
(45) Date of Patent: Dec. 21, 2021

(54) REFRIGERATOR

(71) Applicant: LG Electronics Inc., Seoul (KR)

(72) Inventors: Yonghyun Kim, Seoul (KR); Jinil Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 47 days.

(21) Appl. No.: 16/685,644

(22) Filed: Nov. 15, 2019

(65) Prior Publication Data

US 2020/0158411 A1 May 21, 2020

(30) Foreign Application Priority Data

Nov. 16, 2018 (KR) ..... 10-2018-0142079
Sep. 2, 2019 (KR) ..... 10-2019-0108449

(51) Int. Cl.
*F25C 5/182* (2018.01)
*F25C 1/24* (2018.01)

(52) U.S. Cl.
CPC ..... *F25C 5/182* (2013.01); *F25C 1/24* (2013.01); *F25C 2400/10* (2013.01)

(58) Field of Classification Search
CPC ..... F25C 1/82; F25C 1/24; F25C 2400/08; F25C 5/18; F25D 2323/021; F25D 25/025
See application file for complete search history.

(56) References Cited

U.S. PATENT DOCUMENTS

2013/0014536 A1* 1/2013 Son ..... F25C 1/25 62/351
2014/0130537 A1* 5/2014 Gu ..... F25C 5/22 62/344

FOREIGN PATENT DOCUMENTS

| | | | |
|---|---|---|---|
| EP | 2549207 A2 | | 1/2013 |
| JP | H04/057177 | * | 5/1992 |
| JP | H0457177 U | | 5/1992 |
| JP | H09178316 | * | 7/1997 |
| JP | H1194417 | * | 4/1999 |
| KR | 10-1850918 | | 5/2018 |

OTHER PUBLICATIONS

JPH09178316 translation.*
JPH1194417 translation.*
Partial European Search Report in European Appln. No. 19209361.5, dated Mar. 30, 2020, 14 pages.

* cited by examiner

*Primary Examiner* — Elizabeth J Martin
(74) *Attorney, Agent, or Firm* — Fish & Richardson P.C.

(57) ABSTRACT

A refrigerator includes a cabinet having a freezing compartment, an ice-maker disposed in the freezing compartment to make spherical ice, an ice bin disposed below the ice-maker for storing ice removed from the ice-maker, and an ice tray disposed inside the ice bin. At least a portion of a bottom face of the ice tray is spaced apart from a bottom face of the ice bin, and a plurality of tray holes are defined to pass through the bottom face of the ice tray.

19 Claims, 14 Drawing Sheets

REFRIGERATOR

CROSS-REFERENCE TO RELATED APPLICATION(S)

The application claims priority under 35 U.S.C. § 119 and 35 U.S.C. § 365 to Korean Patent Application Nos. 10-2018-0142079 filed on Nov. 16, 2018, and 10-2019-0108449 filed on Sep. 2, 2019, whose entire disclosures are hereby incorporated by reference.

BACKGROUND

Field of the Disclosure

The present disclosure relates to a refrigerator.

Discussion of the Related Art

In general, a refrigerator is a home appliance for storing foods at a low temperature by low temperature air.

The refrigerator uses cold-air to cool inside of a storage space, so that the stored food may be stored in a refrigerated or frozen state.

Typically, an ice-maker for making ice is provided inside the refrigerator.

The ice-maker is configured to receive water from a water source or a water tank in a tray to make ice.

Further, the ice-maker is configured to remove the ice from the ice tray in a heating or twisting manner after the ice-making is completed.

As such, the ice-maker, which automatically receives the water and removes the ice, has an open top to scoop molded ice.

As described above, the ice made in the ice maker having a structure as described above may have at least one flat surface such as crescent or cubic shape.

When the ice has a spherical shape, it is more convenient to ice the ice, and also, it is possible to provide different feeling of use to a user. Also, even when the made ice is stored, a contact area between the ice cubes may be minimized to minimize sticking between ices with each other.

Korean Patent Registration No. 10-1850918 as Prior Art document discloses an ice maker.

The ice maker of Prior Art document includes an upper tray in which a plurality of upper cells of a hemispherical shape are arranged and a pair of link guides extending upwardly from both sides are disposed, a lower tray in which a plurality of lower cells of a hemispherical shape are arranged and which is pivotally connected to the upper tray, a pivoting shaft connected to rear ends of the lower tray and the upper tray to allow the lower tray to pivot relative to the upper tray, a pair of links having one end thereof connected to the lower tray and the other end thereof connected to the link guide, and an ejecting pin assembly having both ends thereof respectively connected to the pair of links while being respectively inserted into the link guides, wherein the ejecting pin assembly ascends and descends together with the link.

In the prior art, after the spherical ice is made, the ice falls down while being removed from the ice maker. Further, the removed ice may be stored in an ice bin. However, poor appearance of the spherical ice may occur when the ice debris generated during the ice-removal process is attached to the spherical ice.

Further, the spherical ice may roll during the ice-removal process. When the refrigerator door is opened and closed, there is a problem that the ice rolls such that more ice debris may be generated due to the collisions between the ices.

SUMMARY OF THE DISCLOSURE

A purpose of an embodiment of the present disclosure is to provide a refrigerator that prevents an outer shape of ice from being deteriorated by ice debris during storage of spherical ice.

Another purpose of an embodiment of the present disclosure is to provide a refrigerator in which spherical ice and ice debris may be stored separately in an ice bin.

Another purpose of an embodiment of the present disclosure is to provide a refrigerator in which ice is stored in an aligned manner, so that the ice may be easily discharged from an ice bin, which is retracted and extended.

Another purpose of an embodiment of the present disclosure is to provide a refrigerator that prevents spherical ice from moving and being damaged in an ice bin, which is retracted and extended.

In one aspect of the present disclosure, there is provided a refrigerator comprising: a cabinet having a freezing compartment defined therein; an ice-maker disposed in the freezing compartment to make spherical ice, wherein the ice is removed from falls down from the ice maker; an ice bin disposed below the ice-maker for storing ice removed from the ice-maker; and an ice tray disposed inside the ice bin, wherein at least a portion of a bottom face of the ice tray for receiving the ice is spaced apart from a bottom face of the ice bin, wherein a plurality of tray holes are defined to pass through the bottom face of the ice tray.

In one embodiment, the ice bin is configured to extend or retract in a front direction, wherein the bottom face of the ice tray is inclined so that a vertical level a front end thereof is lower than a vertical level of a rear end thereof.

In one embodiment, a freezing compartment contains a drawer disposed below the ice-maker and configured to extend or retract, wherein the ice bin is mounted inside the drawer and moves together with a movement of the drawer.

In one embodiment, a bin mounting guide to guide a mounting position of the ice bin is formed on a bottom face of the drawer facing the ice-maker.

In one embodiment, the bin mounting guide protrudes to constrain a side wall of the ice bin.

In one embodiment, each of the four corners of the ice bin has each leg extending downwards, wherein the bin mounting guide contacts an outer face of the leg to constrain the ice bin.

In one embodiment, the bottom face of the ice tray is inclined such that a vertical level thereof is gradually higher in a retracting direction of the drawer.

In one embodiment, a size of each of the tray holes is smaller than a size of a single spherical ice, wherein the plurality of the tray holes are arranged in an entire area of the bottom face of the ice tray.

In one embodiment, at least a portion of the ice-maker is inserted through an opening in a top face of the ice bin and is received inside the ice bin, wherein a bin opening is recessed in a rear face of the ice bin such that a bottom level of the bin opening is lower than a bottom level of the ice-maker.

In one embodiment, a cover plate extends downwards from the ice maker and shields at least a portion of the bin opening.

In one embodiment, the ice tray has a handle protruding outward and receiving in the bin opening.

In one embodiment, the ice tray has a handle groove defined in one end of the ice tray opposite to the handle, wherein the groove is spaced apart from an inner wall face of the ice bin.

In one embodiment, a spacing between the bottom face of the ice tray and the bottom face of the ice bin increases in a rearward direction of the ice tray.

In one embodiment, a front end of the bottom face of the ice tray contacts and is supported on the ice bin.

In one embodiment, the ice tray includes: a bottom defining a bottom face of the ice tray; a front portion extending upwardly from a front end of the bottom; a rear portion extending upwardly from a rear end of the bottom face; and lateral portions respectively extending upwardly from left and right ends of the bottom, and connecting the front portion and the rear portion, wherein a height of the front portion is larger than a height of the rear portion so that the bottom thereof is inclined relative to the bottom face of the ice bin.

In one embodiment, the rear portion has a handle extending rearward and seated on an end of the ice bin.

In one embodiment, the handle includes: a first extension extending rearward from a top of the rear portion; and a second extension extending downward from a distal end of the first extension.

In one embodiment, a bin opening is recessed downward in a top of a rear face of the ice bin, wherein the first extension is received in the bin opening, while the second extension is exposed to an outside of the bin opening.

In one embodiment, a rim is formed along and bent outwardly from a perimeter of a top of the ice tray, wherein the rim contacts an inner face of the ice bin.

In one embodiment, a handle groove is recessed in an outer portion of the rim to define a space between the rim and the ice bin.

The refrigerator according to the present disclosure has the following effects.

According to this embodiment, when the spherical ice is removed from the ice-maker and falls downward, the ice may be accommodated in the ice bin. In this connection, the spherical ice may be placed in the ice tray while an ice tray with the multiple holes defined therein is mounted in the ice bin.

In one example, the ice-maker may generate ice debris in the process of ice-removal of the ice. The ice debris may be placed on the bottom of the ice bin through the tray holes formed in the ice tray even when the ice debris falls downs. Therefore, the spherical ice may be placed on the ice tray while not being affected by the ice debris.

In other words, the ice debris may be prevented from adhering to the surface of the spherical ice during the storage of the spherical ice. Therefore, this may always provide the user with the spherical ice having a smooth surface.

Further, inside the ice bin, the spherical ice is placed on the ice tray. The ice debris may be placed and stored inside the ice bin in a separated manner from the spherical ice. Thus, the user may take the spherical ice out of the ice tray and use the ice. The ice debris inside the ice bin are stored on the bottom of the ice bin, and may be easily removed after the ice tray is removed.

Further, the ice bin is configured to extend or retract in a front direction. The bottom of the ice tray is shaped to have an inclined slope such that a front portion is lower than a rear portion. Thus, the spherical ice may fall and roll and stored in the front half of the tray.

Thus, when withdrawing the ice bin, the user may easily access the ice stored in the ice tray and may easily take out the ice.

Further, the bottom of the ice tray is formed obliquely so that the spherical ices may be evenly horizontally distributed in the ice tray. Further, in the movement of the ice bin, the ice may be prevented from excessively rolling or moving inside the ice tray.

Thus, this may prevent the spherical ice from hitting each other and damaging the surface thereof so that the ice debris does not occur to keep the spherical ice surface smooth.

Further, the spherical ice removed from the ice maker falls onto the ice tray and then rolls to the front of the ice tray. In this process, the ice contacts the neighboring ice or ice tray such that the burr around the spherical ice may be removed. Thus, the spherical ice may become more spherical. The ice debris caused by the removal of the burr may be discharged through the tray holes onto the bottom of the ice bin so that only the spherical ices may be stored.

DESCRIPTION OF SPECIFIC EMBODIMENTS

Figure 1:
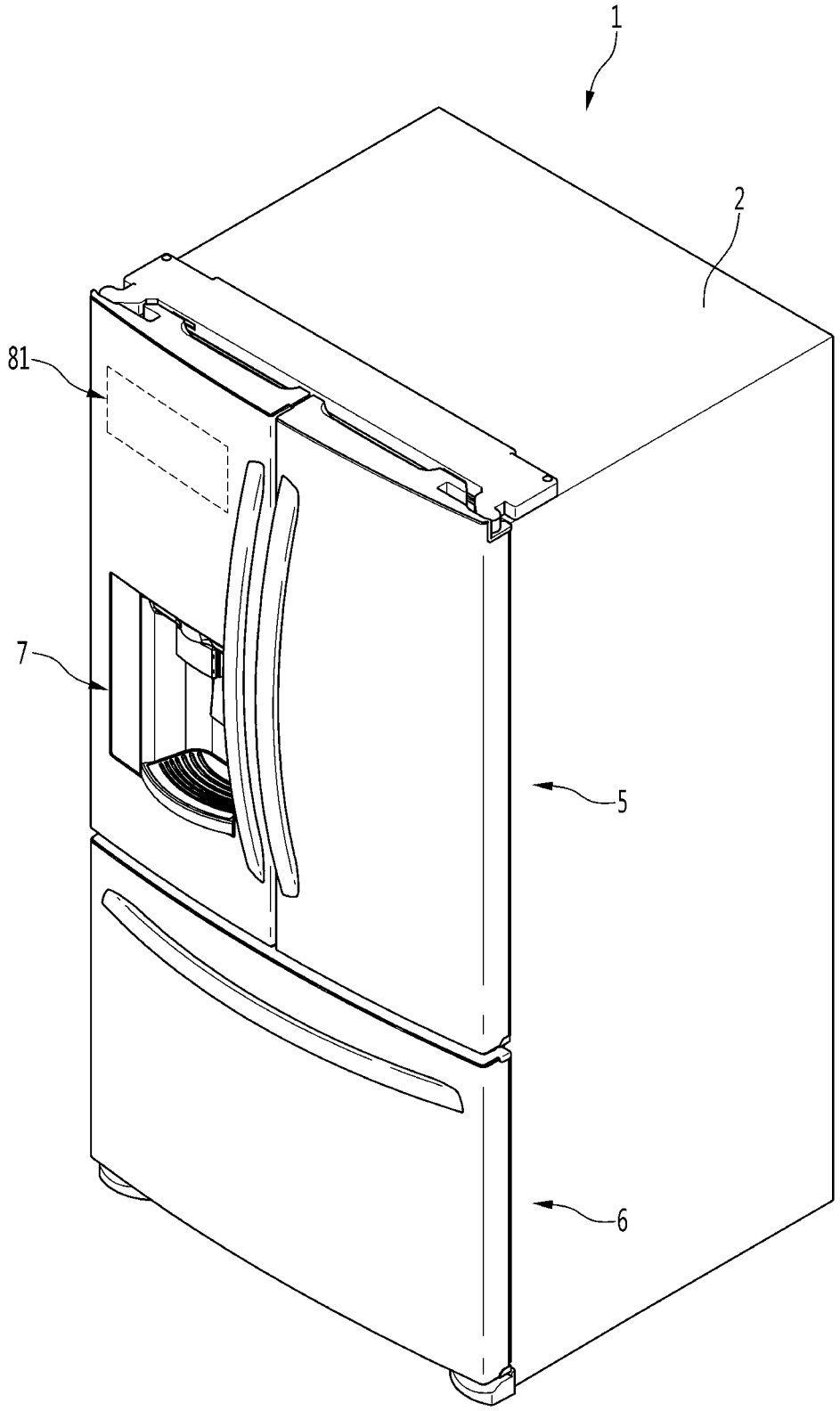
FIG. 1 is a perspective view of a refrigerator according to an embodiment of the present disclosure.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
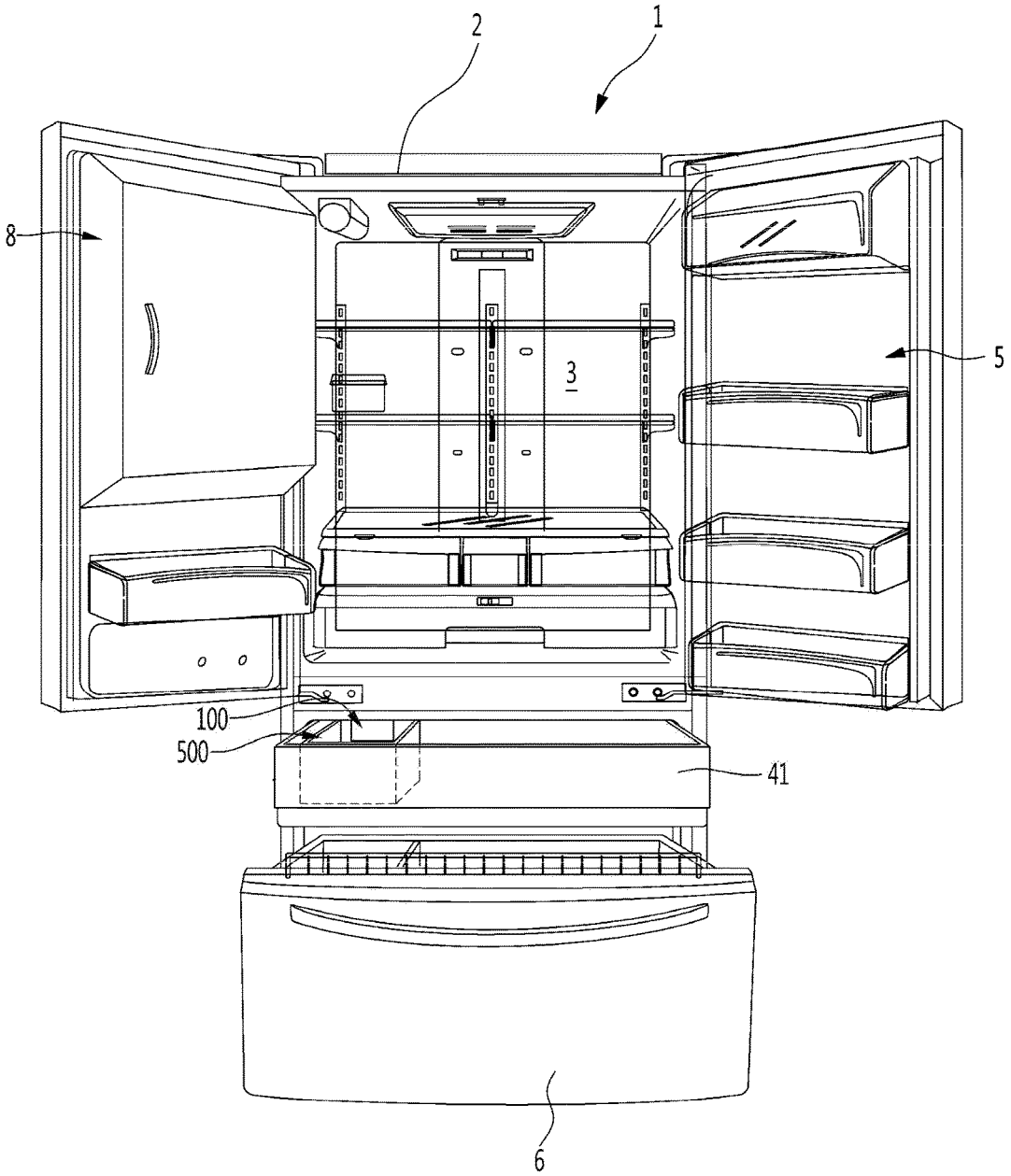
FIG. 2 is a view showing a state in which a door is opened.

FIG. 1 is a perspective view of a refrigerator according to an embodiment of the present disclosure. Further, FIG. 2 is a view showing a state in which a door is opened. Further, FIG. 3 is a partial enlarged view of an ice-maker according to an embodiment of the present disclosure.

For convenience of description and understanding, directions will be defined. Hereinafter, based on a bottom face on which the refrigerator is installed, a direction toward the bottom face may be referred to as a downward direction, and a direction toward a top face of a cabinet 2, which is opposite to the bottom face, may be referred to as an upward direction. Further, when an undefined direction is described, the direction may be described by being defined based on each drawing.

Figure 3:
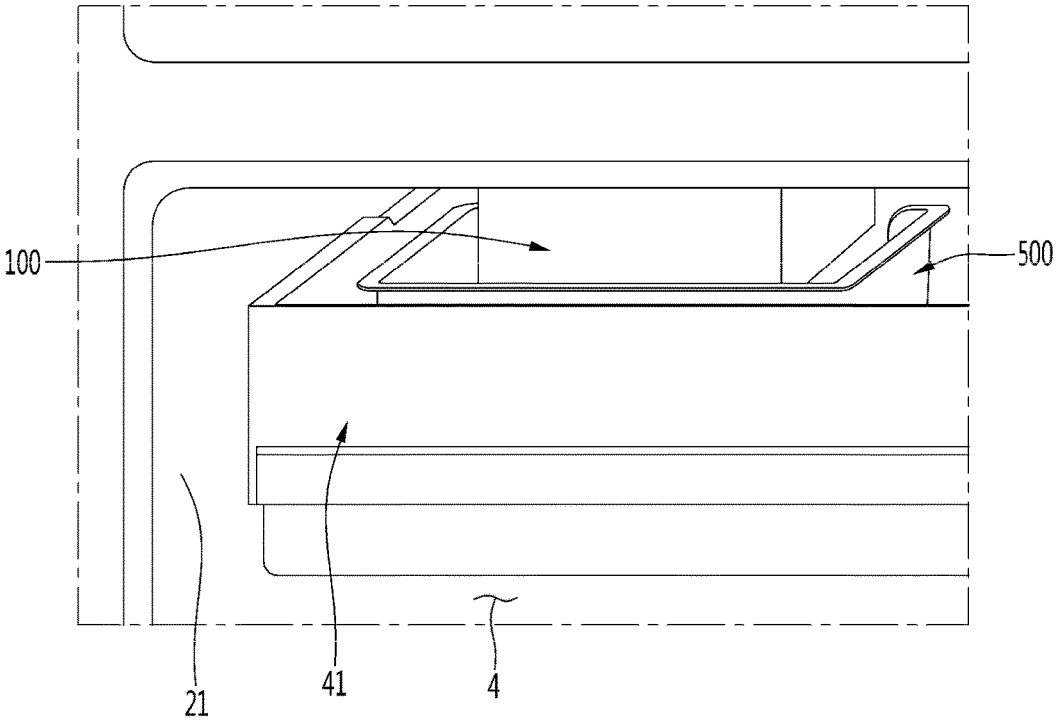
FIG. 3 is a partial enlarged view illustrating a state in which an ice-maker is mounted according to an embodiment of the present disclosure.

Referring to FIGS. 1 to 3, a refrigerator 1 according to an embodiment of the present disclosure may include a cabinet 2 for defining a storage space therein, and a door for opening and closing the storage space.

In detail, the cabinet 2 defines the storage space vertically divided by a barrier. A refrigerating compartment 3 may be defined at an upper portion of the storage space, and a freezing compartment 4 may be defined at a lower portion of the storage space.

An accommodation member such as a drawer, a shelf, a basket, and the like may be disposed in each of the refrigerating compartment 3 and the freezing compartment 4.

The door may include a refrigerating compartment door 5 shielding the refrigerating compartment 3 and a freezing compartment door 6 shielding the freezing compartment 4.

The refrigerating compartment door 5 includes a pair of left and right doors, which may be opened and closed by pivoting. Further, the freezing compartment door 6 may be disposed to be retractable or extendable like a drawer.

In another example, the arrangement of the refrigerating compartment 3 and the freezing compartment 4 and the shape of the door may be changed based on kinds of the refrigerators. However, the present disclosure may not be limited thereto, and may be applied to various kinds of refrigerators. For example, the freezing compartment 4 and the refrigerating compartment 3 may be arranged horizontally, or the freezing compartment 4 may be disposed above the refrigerating compartment 3.

In one example, one of the pair of refrigerating compartment doors 5 on both sides may have an ice-making chamber 8 defined therein for receiving a main ice-maker 81. The ice-making chamber 8 may receive cold-air from an evaporator (not shown) in the cabinet 2 to allow ice to be made in the main ice-maker 81, and may define an insulated space together with the refrigerating compartment 3. In another example, depending on a structure of the refrigerator, the ice-making chamber may be defined inside the refrigerating compartment 3 rather than the refrigerating compartment door 5, and the main ice-maker 81 may be disposed inside the ice-making chamber.

A dispenser 7 may be disposed on one side of the refrigerating compartment door 5, which corresponds to a position of the ice-making chamber 8. The dispenser 7 may be capable of dispensing water or ice, and may have a structure in communication with the ice-making chamber 8 to enable dispensing of ice made in the ice-maker 81.

In one example, the freezing compartment 4 may be equipped with an ice-maker 100. The ice-maker 100, which makes ice using water supplied, may produce ice in a spherical shape. The ice-maker 100 may be referred to as an auxiliary ice-maker because the ice-maker 100 usually generates less ice than the main ice-maker 81 or is used less than the main ice-maker 81.

The freezing compartment 4 may be equipped with a duct 44 for supplying cold-air to the freezing compartment 100. Thus, a portion of the cold-air generated in the evaporator and supplied to the freezing compartment 4 may be flowed toward the ice-maker 100 to make ice in an indirect cooling manner.

Further, an ice bin 500 in which the made ice is stored after being transferred from the ice maker 100 may be further provided below the ice maker 100. Further, the ice bin 500 may be disposed in a freezing compartment drawer 41 which is extended from the freezing compartment 4. Further, the ice bin 500 may be configured to be retracted and extended together with the freezing compartment drawer 41 to allow a user to take out the stored ice.

Thus, the ice-maker 100 and the ice bin 500 may be viewed as at least a portion of which is received in the freezing compartment drawer 41. Further, a large portion of the ice-maker 100 and the ice bin 500 may be hidden when viewed from the outside. Further, the ice stored in the ice bin 500 may be easily taken out by the retraction and extension of the freezing compartment drawer 41.

In another example, the ice made in the ice-maker 100 or the ice stored in the ice bin 500 may be transferred to the dispenser 7 by transfer means and dispensed through the dispenser 7.

In another example, the refrigerator 1 may not include the dispenser 7 and the main ice-maker 81, but include only the ice-maker 1. The ice-maker 100 may be disposed in the ice-making chamber 8 in place of the main ice-maker 81.

Hereinafter, the mounting structure of the ice-maker 100 will be described in detail with reference to the accompanying drawings.

Hereinafter, a mounting structure of the ice-maker 100 will be described in detail with reference to the accompanying drawings.

Figure 4:
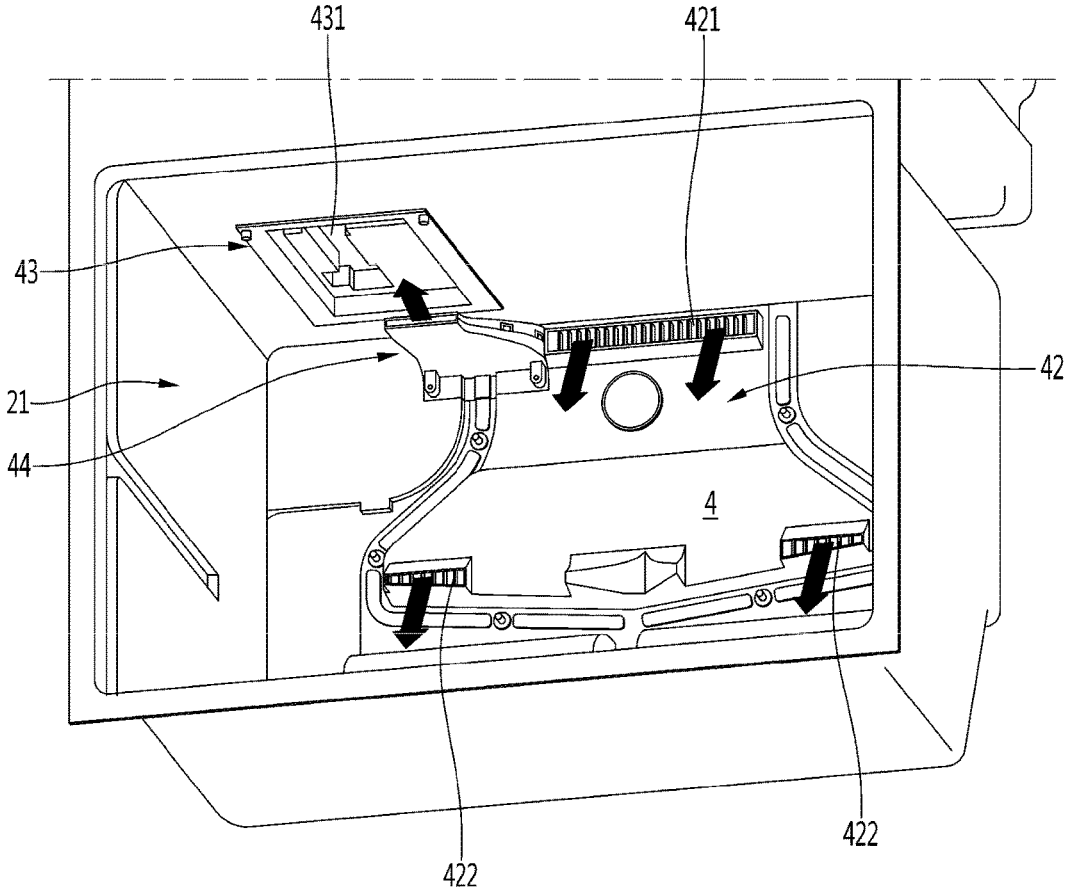
FIG. 4 is a partial perspective view illustrating an interior of a freezing compartment according to an embodiment of the present disclosure.
Figure 5:
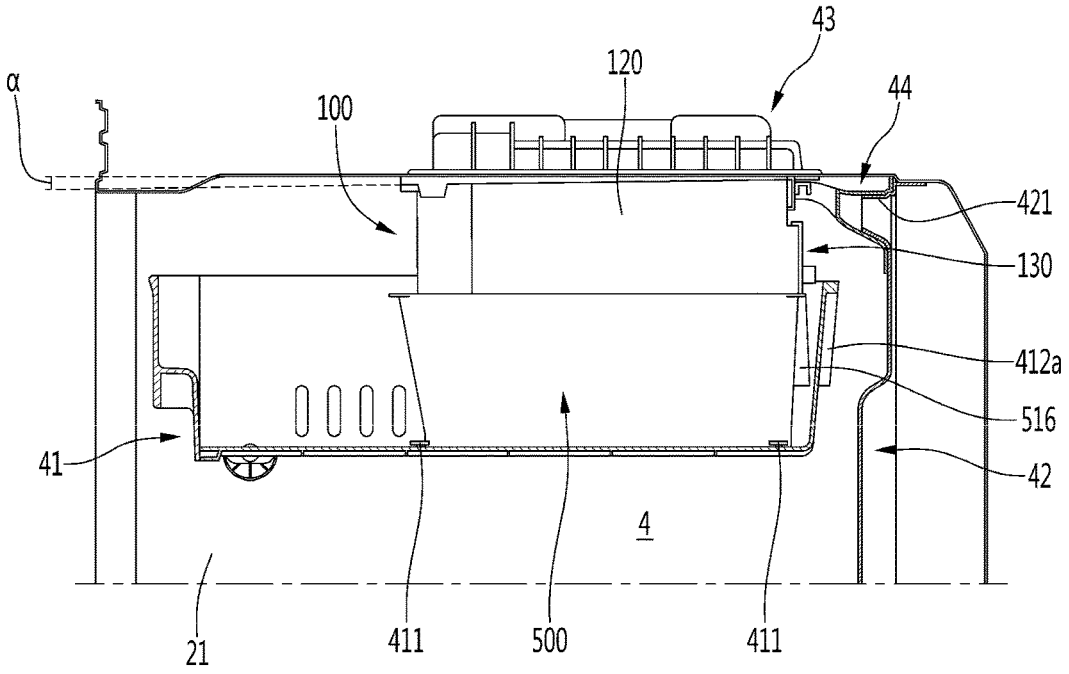
FIG. 5 is a cross-sectional side view of a freezing compartment in a state in which a freezing compartment drawer and an ice bin are retracted therein, according to an embodiment of the present disclosure.
Figure 6:
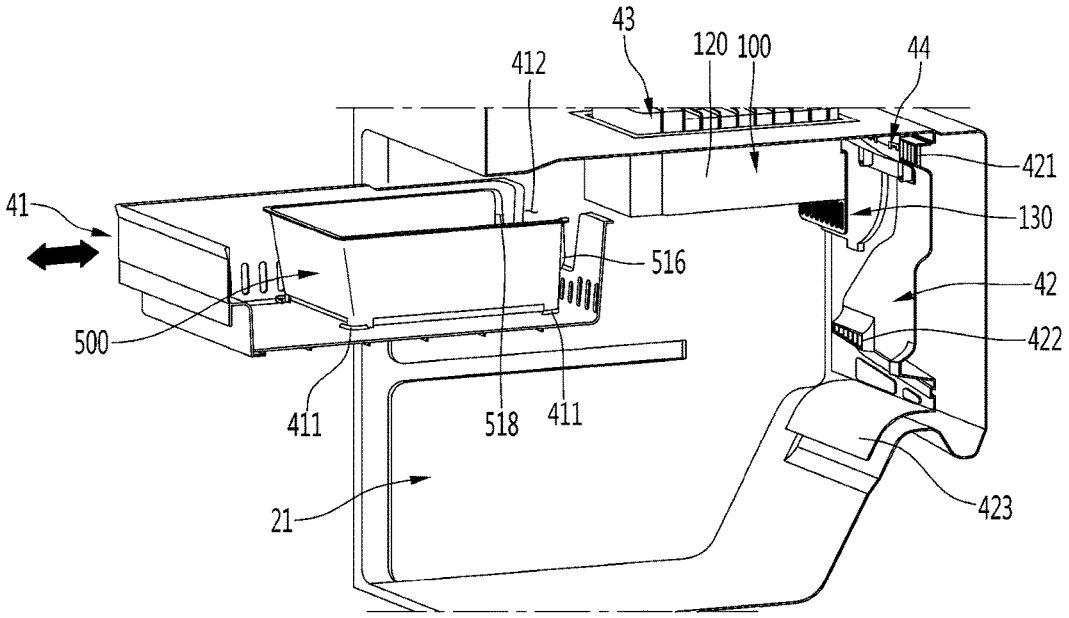
FIG. 6 is a partially-cut perspective view of a freezing compartment in a state in which a freezing compartment drawer and an ice bin are extended therefrom.

FIG. 4 is a partial perspective view illustrating an interior of a freezing compartment according to an embodiment of the present disclosure. FIG. 5 is a cross-sectional side view of a freezing compartment in a state in which a freezing compartment drawer and an ice bin are retracted therein, according to an embodiment of the present disclosure. FIG. 6 is a partially-cut perspective view of a freezing compartment in a state in which a freezing compartment drawer and an ice bin are extended therefrom.

As shown in FIGS. 4 to 6, the storage space inside the cabinet 2 may be defined by an inner casing 21. Further, the inner casing 21 defines the vertically divided storage space, that is, the refrigerating compartment 3 and freezing compartment 4.

A portion of a top face of the freezing compartment 4 may be opened, and a mounting cover 43 may be formed at a position corresponding to a position where the ice-maker 100 is mounted. The mounting cover 43 may be coupled and fixed to the inner casing 21, and define a space further recessed upwardly from the top face of the freezing compartment 4 to secure a space in which the ice-maker 100 is disposed. Further, the mounting cover 43 may include a structure for fixing and mounting the ice-maker 100.

Further, the mounting cover 43 may further include a cover recess 431 defined therein, which may be further recessed upwards to receive an upper ejector 300 to be described below. Since the upper ejector 300 has a structure that protrudes upward from the top face of the ice-maker 100, the upper ejector 300 may be received in the cover recess 431 to minimize a space used by the ice-maker 100.

A rear wall face of the freezing compartment 4 may be formed by a grill pan 42. The grill pan 42 may divide the space in the inner casing 21 horizontally, and may define, at rearward of the freezing compartment, a space for receiving an evaporator (not shown) that generates the cold-air and a blower fan (not shown) that circulates the cold-air therein.

The grill pan 42 may include cold-air ejectors 421 and 422 and a cold-air absorber 423. Thus, the cold-air ejectors 421 and 422 and the cold-air absorber 423 may allow air circulation between the freezing compartment 4 and the space in which the evaporator is placed, and may cool the freezing compartment 4. The cold-air ejectors 421 and 422 may be formed in a grill shape. The cold-air may be evenly discharged into the freezing compartment 4 through the upper cold-air ejector 421 and the lower cold-air ejector 422.

In particular, the upper cold-air ejector 421 may be disposed at a top of the freezing compartment 4. Further, the cold-air discharged from the upper cold-air ejector 421 may be used to cool the ice-maker 100 and the ice bin 500 arranged at an upper portion of the freezing compartment 4. In particular, the upper cold-air ejector 421 may include the cold-air duct 44 for supplying the cold-air to the ice-maker 100.

The cold-air duct 44 may connect the upper cold-air ejector 421 to the cold-air hole 134 of the ice-maker 100. That is, the cold-air duct 44 may connect the upper cold-air ejector 421 located at a center of the freezing compartment 4 in the horizontal direction and the ice-maker 100 located at an upper end of the freezing compartment 4, so that a portion of the cold-air discharged from the upper cold-air ejector 421 may be supplied directly into the ice-maker 100.

In one example, the ice bin 500 may be mounted inside the freezing compartment drawer 41. The ice bin 500 is positioned exactly under the ice-maker 100 while the freezing compartment drawer 41 is retracted. To this end, the freezing compartment drawer 41 may be provided with a bin mounting guide 411 which guides the mounting position of the ice bin 500. The bin mounting guide 411 protrudes upward in a position corresponding to each leg 514 protruding from each of the four corners of the bottom face of the ice bin 500, and may be configured to surround an outer face of the leg 514. Thus, a position of the ice bin 500 may be maintained while being mounted to the freezing compartment drawer 41 even when the freezing compartment drawer 41 is in an extended state. Further, while the freezing compartment drawer 41 is in a retracted state, the ice bin 500 may be located vertically below the ice-maker 100. Thus, the ice that is removed from the ice-maker 100 may fall into the ice bin 500 and be stored therein.

The bottom of the ice-maker 100 may be housed inside the ice bin 500 while the freezing compartment drawer 41 is in a retracted state. That is, the bottom of the ice-maker 100 may be located in the inner region of the ice bin 500 and the freezing compartment drawer 41. Thus, ice that is removed from the ice-maker 100 may fall and be stored in the ice bin 500. Further, minimizing the space between the ice-maker 100 and the ice bin 500 may minimize the volume loss inside the freezing compartment 4 due to the presence of the ice-maker 100 and ice bin 500. In another example, the bottom of the ice-maker 100 and the bottom face of the ice bin 500 may be spaced apart by an appropriate distance to ensure that an appropriate amount of ice may be stored.

In one example, in the state where the ice maker 100 is mounted to the drawer, the freezer compartment drawer 41 may be withdrawn as shown in FIG. 6. At this time, at least a portion of the rear face of each of the ice bin 500 and the freezer compartment drawer 41 may be opened to prevent interference with the ice maker 100.

In detail, a drawer opening 412 and a bin opening 518 may be respectively defined in the rear faces of the freezing compartment drawer 41 and the ice bin 500 corresponding to the position of the ice-maker 100. The drawer opening 412 and the bin opening 518 may be respectively defined at positions facing each other. Further, the drawer opening 412 and the bin opening 518 may be respectively defined to open from the top of the freezing compartment drawer 41 and the top of the ice bin 500 to positions lower than the bottom of the ice-maker 100.

Thus, even when the freezing compartment drawer 41 is extended in a state in which the ice-maker 100 is mounted therein, the ice-maker 100 may be prevented from interfering with the ice bin 500 and the freezing compartment drawer 41.

In particular, even in a state in which the ice-maker 100 removes the ice and the lower assembly 200 is pivoted, or in a state in which an ice-full state detection lever 700 is pivoted to detect an ice-full state, the drawer opening 412 and the bin opening 518 may be in a shape of being recessed further downward from the bottom of the ice-maker 100 to prevent interference with the freezing compartment drawer 41 or the ice bin 500. A drawer opening guide 412*a* extends rearward along a perimeter of the drawer opening 412.

Further, a bin opening guide 102*b* may extend rearward along the circumference of the bin opening 518. The bin opening 518 may be defined in a recessed manner by the bin opening guide 516.

In one example, a cover plate 130 in a plate shape may be disposed on a rear face of the upper casing 120 of the ice-maker 100. The cover plate 130 may be formed to cover at least a portion of the ice bin opening 518 such that the ice inside the ice bin 500 does not fall downward through the bin opening 518 and the drawer opening 412.

Hereinafter, the structure of the ice bin 500 will be described in more detail with reference to the accompanying drawings.

Figure 7:
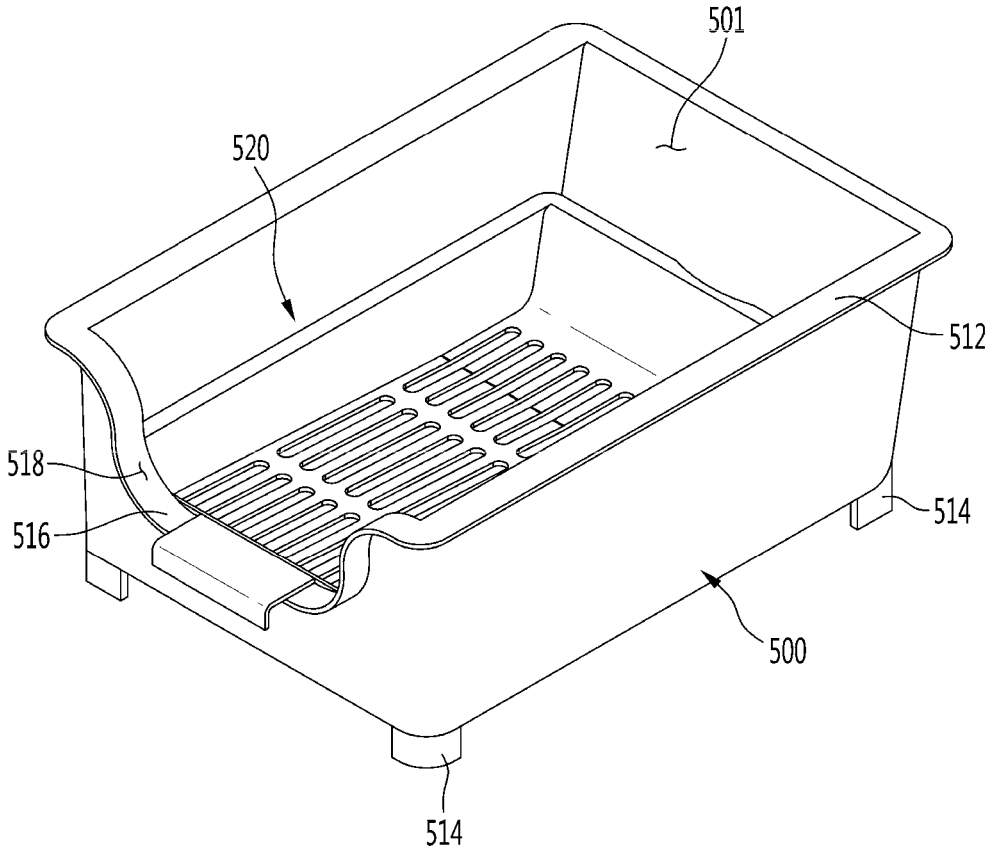
FIG. 7 is a perspective view in a state in which an ice tray is mounted on an ice bin according to the present disclosure embodiment.
Figure 8:
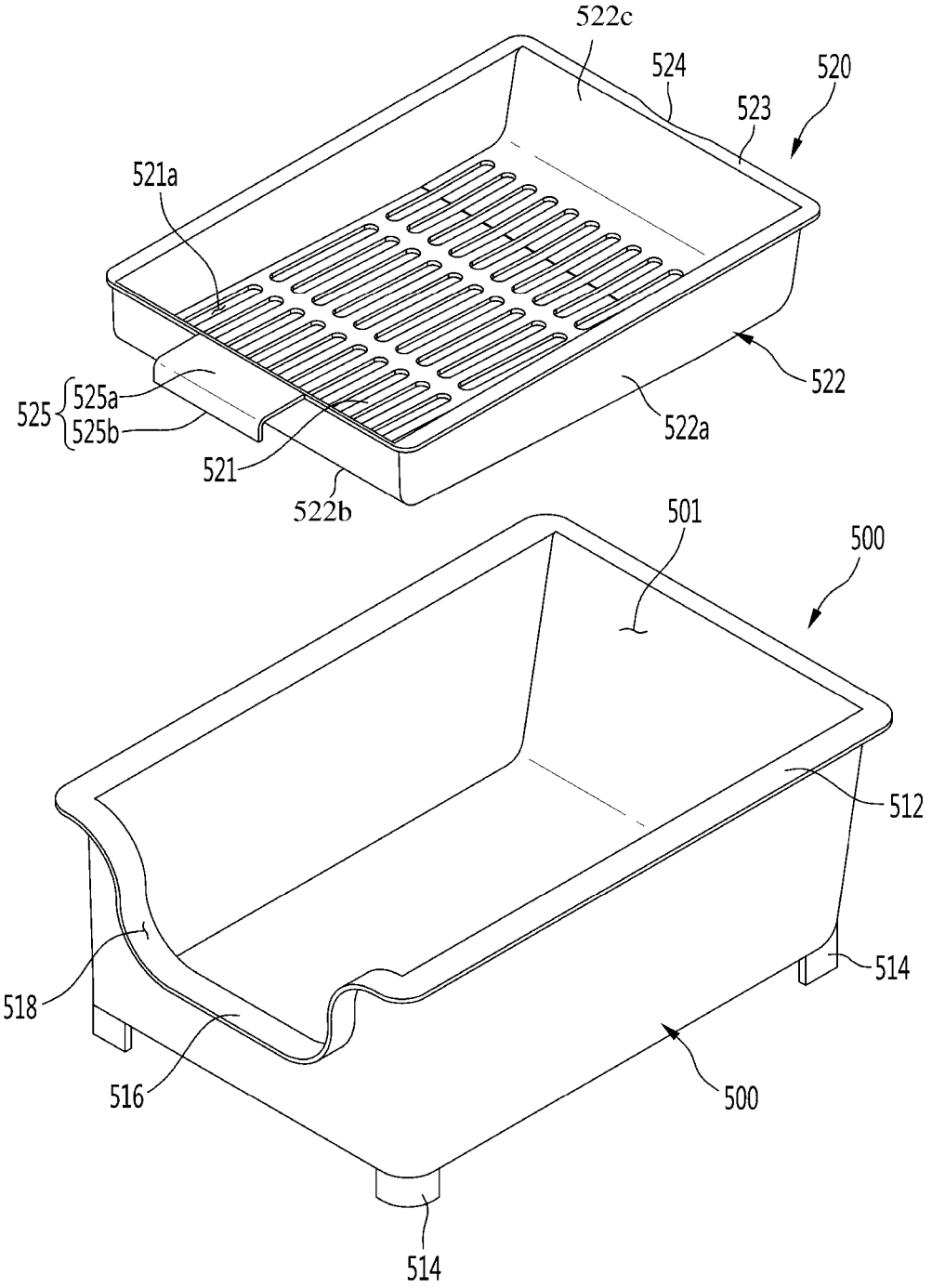
FIG. 8 is an exploded perspective view of the ice bin and ice tray.
Figure 9:
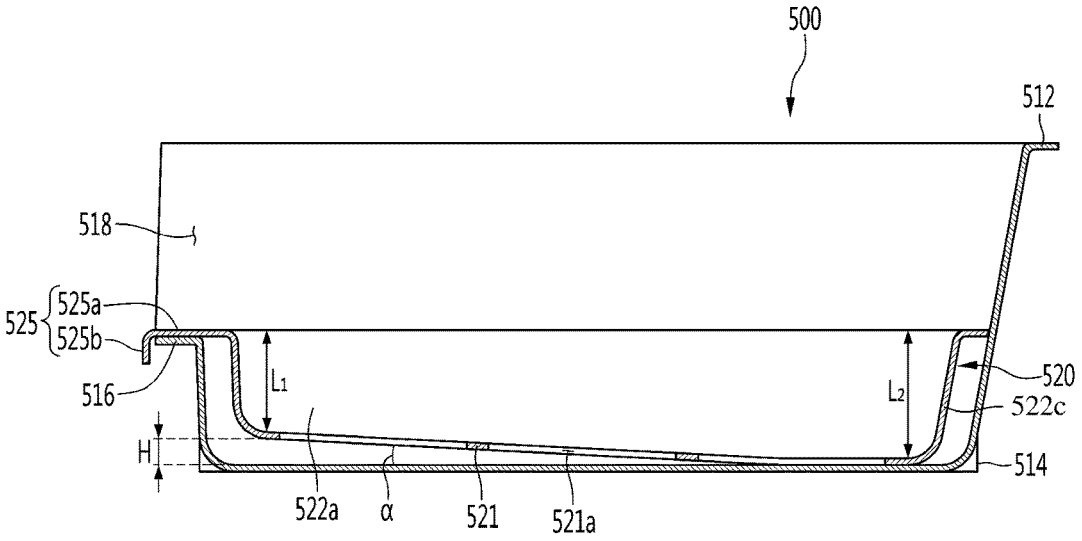
FIG. 9 is a cross-sectional view in a state in which the ice tray is mounted on the ice bin.

FIG. 7 is a perspective view in a state in which an ice tray is mounted on an ice bin according to the present disclosure embodiment. FIG. 8 is an exploded perspective view of the ice bin and ice tray. FIG. 9 is a cross-sectional view in a state in which the ice tray is mounted on the ice bin.

Referring to the drawings, the ice bin 500 may be formed in a box shape opened upwards. An accommodating space 501 may be formed therein to provide a space in which ice may be stored.

Around the opened top of the ice bin 500, an outwardly extending bin edge 512 may be formed. In one example, the bin opening 518 as recessed downward may be formed at the top of the bin edge 512 corresponding to the rear face of the ice bin 500. The bin opening 518 may be defined by a bin opening guide 516.

Further, each of four corners of the bottom face of the ice bin 500 may have a leg 514 extending downwards. The leg 514 may be extended to have a predetermined length and may be formed to be round. When the ice bin 500 is mounted on the freezing compartment drawer 41, the freezing compartment drawer may be in contact with the inner surface of the bin mounting guide 411 so that the ice bin 500 is mounted at a correct position.

An ice tray 520 may be formed inside the ice bin 500. The ice tray 520 may partition the inner space of the ice bin 500 vertically. Ice falling from the ice-maker 100 may settle on the ice tray.

The bottom face of the ice tray 520 may be at least partially spaced apart from the bottom face of the ice bin 500. Further, tray holes 521*a* may be formed in an entirety of the bottom face of the ice tray 520.

A size of each of the tray holes 521*a* may be smaller than the size of the spherical ice. The tray holes 521*a* may be arranged horizontally throughout the bottom face of the ice tray 520.

In one example, each of the tray holes 521*a* may be formed in an elongate hole shape. A plurality of the tray holes 521*a* may be continuously arranged at a regular spacing in a left and right direction and the front and rear direction. Further, in another example, the bottom face of the ice tray 520 may be formed into a mesh or grill shape through which ice debris may pass downwards.

The ice tray 520 may include a bottom 521 forming a bottom face and a side wall 522 extending upward along the outer edge of the bottom 521.

Further, the side wall 522 may include a front portion 522*c* extending upward from the front end of the bottom 521, and a rear portion 522*b* extending upward from the rear end of the bottom 521, and lateral portions 522*a* extending from the left and right sides of the bottom 521 522*a*.

A top face of the ice tray 520 may be non-inclined when mounted on the ice bin 500. Further, a length L1 of the rear portion 522*b* of the ice tray 520 may be smaller than a length L2 of the front portion 522*c*. That is, the bottom of the front portion 522*c* may extend more downwardly than the bottom of the rear portion 522*b* extends. As a result, the bottom face of the ice tray 520 may be formed to be inclined.

The bottom 521 may be formed such that the height thereof may gradually be smaller from the rear to the front. Further, a spacing between the bottom 521 and the bottom face of the ice bin 500 may increase as it goes from front to back.

While the ice tray 520 is mounted inside the ice bin 500, a angle $\alpha$ approximately 7° to 15° between the bottom face of the ice bin 500 and the bottom face of the ice tray 520 may be maintained. In this connection, the front end of the ice tray 520 may contact the bottom face of the ice bin 500, while the rear end of the ice tray 520 may be spaced apart by a predefined height H from the bottom face of the ice bin 500.

Thus, the spherical ice that is removed from the ice maker falls downward and rolls and moves along the bottom 521. Further, the spherical ice moving along the bottom 521 may stop at the front end of the bottom 521, and then first fill therein. Then, the continuous ice-making and ice-removal of the ice-maker 100 may fill the spherical ices into the ice tray 520 sequentially in a reward direction.

In particular, the bottom 521 may have the tray holes 521*a* defined therein. Ice debris generated during the ice-removal operation of the ice-maker 100 or during the process of moving the spherical ice may be discharged downward through the tray holes 521*a*. Thus, the spherical ices may be arranged in the ice tray 520 sequentially in a reward direction while the ice debris may not attach to the spherical ices.

The lateral portions 522*a* extends upwards respectively from both left and right sides of the bottom face of the ice tray 520. The lateral portions 522*a* may connect the front portion 522*c* and the rear portion 522*b* to each other to define the side wall of the ice tray 520.

In one example, a tray rim 523 extending outwards may be formed around the opened top of the ice tray 520. The tray rim 523 may extend outwards, and may be in contact with the inner surface of the ice bin 500 while the ice tray 520 is mounted inside the ice bin 500. Thus, when the ice tray 520 is accommodated inside the ice bin 500, the ice tray 520 may not move and maintain a stable mounting state.

A handle 525 may be formed at a rear edge of the tray rim 523. That is, the handle 525 may protrude rearward from the top of the rear portion 522*b*. The handle 525 may be gripped by the user when the ice tray 520 is removed. Further, the handle 525 may be seated in the bin opening 518 while the ice tray 520 is mounted into the ice bin 500. Thus, the handle 525 may have a left and right width such that the handle may be received in the bin opening 518.

A bin opening guide 516 may extend rearward along the bin opening 518. The bin opening guide 516 may define a portion of the tray rim 523. In other words, a bottom of the tray rim 523 may be recessed to define the bin opening 518.

The handle 525 may include a first extension 525*a* extending rearward from the top of the rear portion 522*b* and a second extension 525*a* extending downward from am end of the first extension 525*a*.

A length of the first extension 525*a* may be equal to or larger than a width of the bin opening guide 516. Thus, the first extension 525*a* may be seated on the inner side of the bin opening 518. Further, the second extension 525*b* may extend downwards from the end of the first extension 525*a* and may be exposed to the outside of the bin opening 518. Thus, the first extension 525*a* may allow the handle 525 to stop in the bin opening 518 and thus prevent the ice tray 520 from moving or removing. Further, the second extension 525*a* extends further downwardly of the bin opening 518, thereby creating a space in which user may grip the handle 525.

In one example, a handle groove 524 may be formed in the front end of the ice tray 520 opposite to the handle 525. The handle groove 524 may be formed at a position corresponding to the top of the front portion 522*c* and may be recessed in the center of the front end of the tray rim 523.

Thus, while the ice tray 520 is mounted to the ice bin 500, the handle groove 524 may be spaced apart from the inner wall of the ice bin 500 to allow a space for the user to put his hand into the ice bin. When the user wishes to detach the ice tray 520 from the ice bin 500, the user may grip the handle 525 and put the hand into the ice bin through the handle groove 524 and may lift up the ice tray 520.

Hereinafter, the ice-maker 100 will be described in detail with reference to the accompanying drawings.

Figure 10:
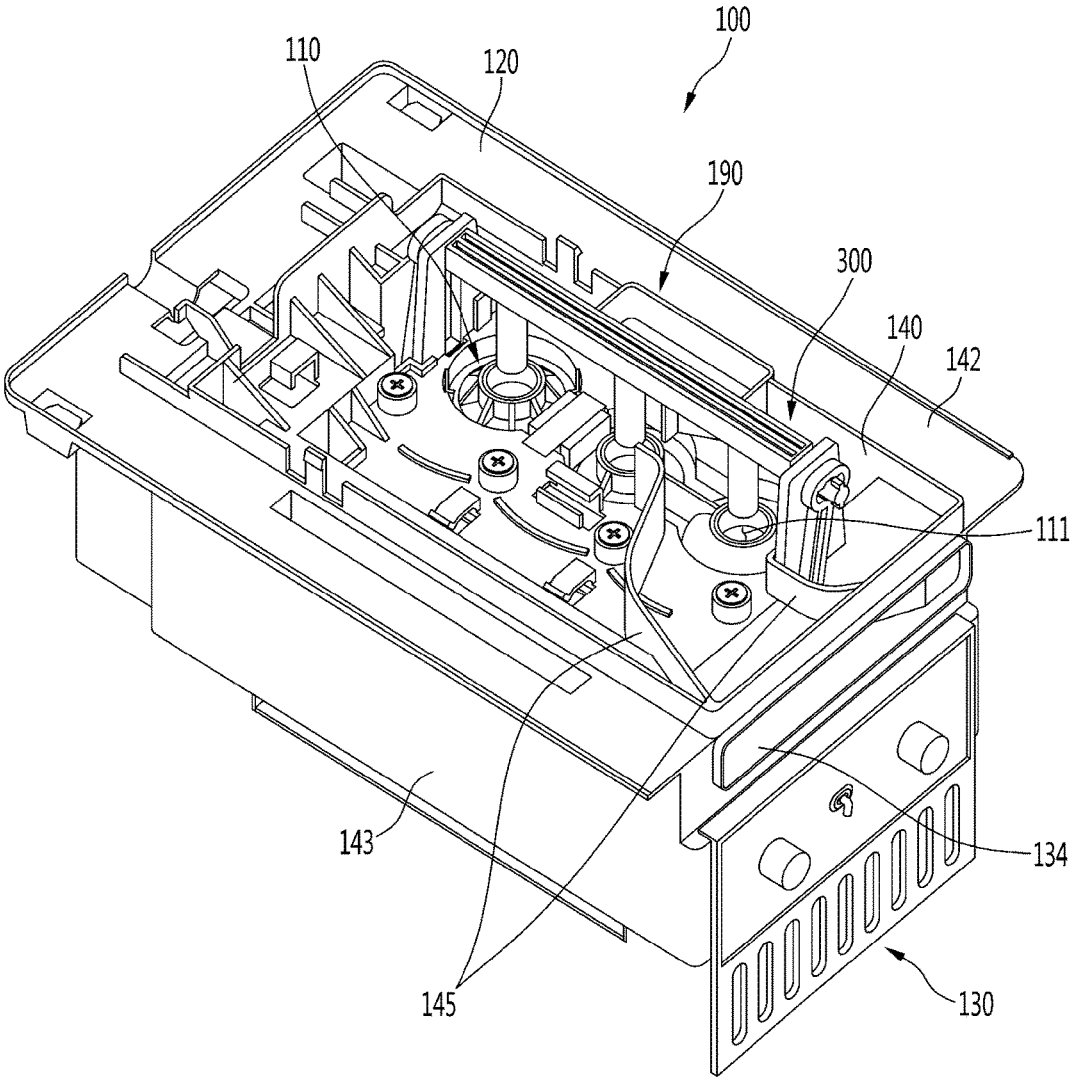
FIG. 10 is a perspective view of an ice-maker viewed from above.
Figure 11:
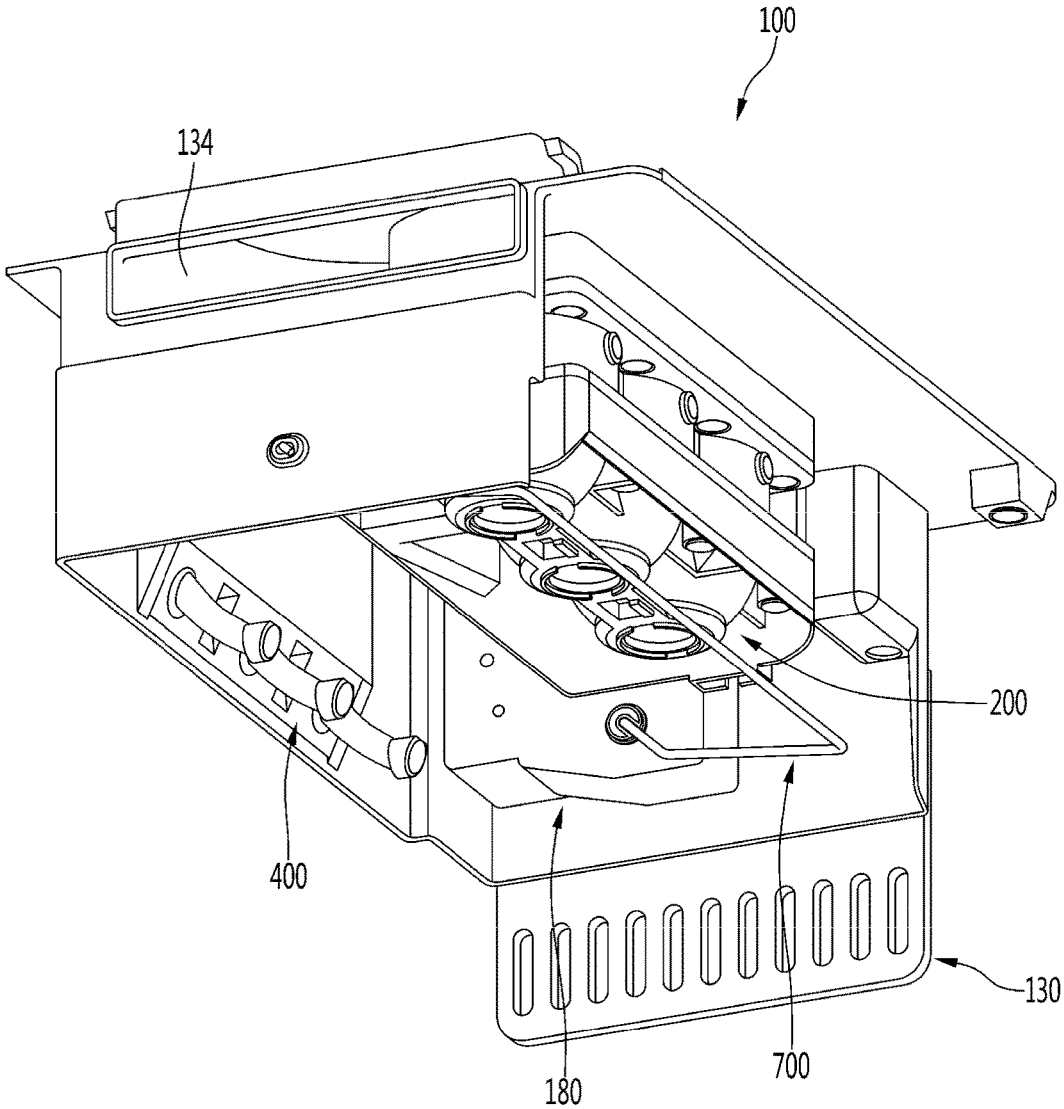
FIG. 11 is a perspective view of an ice-maker viewed from below.
Figure 12:
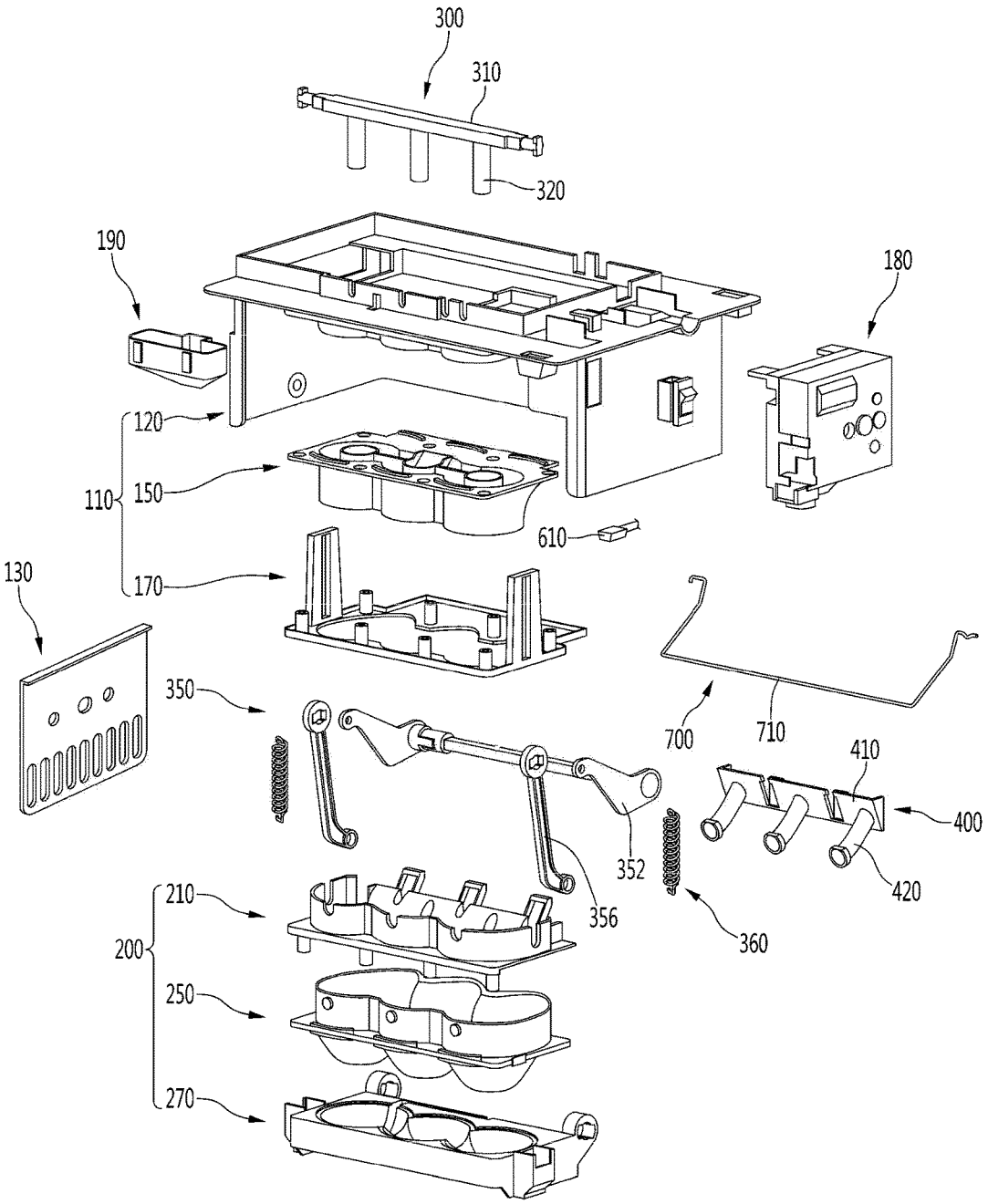
FIG. 12 is an exploded perspective view of an ice-maker.

FIG. 10 is a top perspective view of the ice-maker. Further, FIG. 11 is a perspective view of the ice-maker from below. Further, FIG. 12 is an exploded perspective view of the ice-maker.

Referring to the drawings, the ice-maker 100 may include an upper assembly 110 and a lower assembly 200. The lower assembly 200 may be pivotally mounted onto one end of the upper assembly 110. The pivoting motion may open and close the inner space defined by the lower assembly 200 and the upper assembly 110.

In detail, the lower assembly 200 is in contact with the upper assembly 110 to define the spherical ice chamber such that the spherical ice may be generated therein.

That is, the upper assembly 110 and the lower assembly 200 may define an ice chamber 111 for generating spherical ice. The ice chamber 111 is substantially a spherical chamber. The upper assembly 110 and the lower assembly 200 may defined a plurality of partitioned ice chambers 111.

While the upper assembly 110 and the lower assembly 200 define the ice chambers 111, water may be supplied to the ice chamber 111 via a water supply 190.

After ice is formed, the lower assembly 200 may pivot in the forward direction. Then, the spherical ice formed between the upper assembly 110 and the lower assembly 200 may be separated from the upper assembly 110 and the lower assembly 200 and then may fall into the ice bin 500.

In one example, the ice-maker 100 may further include a driver 180 such that the lower assembly 200 is pivotable relative to the upper assembly 110. The driver 180 may be composed of a combination of a driving motor and a plurality of gears for transmitting power of the driving motor to the lower assembly 200. Further, the driver 180 may be connected to an ice-full state detection lever 700. The ice-full state detection lever 700 may pivot via the power transmission.

The ice-maker 100 may further include an upper ejector 300 so that ice may be separated from the upper assembly 110. The upper ejector 300 may cause the ice in close contact with the upper assembly 110 to be released from the upper assembly 110.

The upper ejector 300 may include an ejector body 310 and one or more ejecting pins 320 extending in a direction intersecting the ejector body 310. The number of the ejecting pins 320 may be the same as the number of the ice chambers 111. Each pin may allow ice generated in each ice chamber 111 to be removed from each chamber.

The ice in the ice chamber 111 may be pressurized by the pin in a process where the ejecting pin 320 is inserted into the ice chamber 111 through the upper assembly 110. The ice as pressed by the ejecting pin 320 may be disengaged from the upper assembly 110.

Further, the ice-maker 100 may further include a lower ejector 400 so that the ice in close contact with the lower assembly 200 may be separated from the lower assembly 120. The lower ejector 400 may include a lower ejector body 410 fixed to the inner side of the upper casing and each lower ejecting rod 420 extending from the lower ejector body 410 toward each ice chamber 111 of the lower tray 250.

An end of the lower ejecting rod 420 may be located within the pivoting range of the lower assembly 200. In the pivoting process of the lower assembly 200, the ice may be removed from the lower assembly by the rod 420 pressing the bottom of the ice chamber 111, the bottom face of the lower tray.

In one example, the pivoting force of the lower assembly 200 may be transmitted to the upper ejector 300 in the pivoting process of the lower assembly 200 for ice-removal. To this end, the ice-maker 100 may further include a connector 350 connecting the lower assembly 200 and the upper ejector 300. The connector 350 may include one or more links.

In one example, the connector 350 may include a pair of a pivoting arm 352 and a link 356. The pivoting arm 352 may pivot together with a lower support 270 connected to the driver 180. Further, an end of the pivoting arm 352 may be connected to the lower support 270 via an elastic member 360 such that the pivoting arm may be in close contact with the upper assembly 110 while the lower assembly 200 is in a closing state.

The link 356 connects the lower support 270 with the upper ejector 300 so that the pivoting force of the lower support 270 may be transmitted to the upper ejector 300 when the lower support 270 pivots. The upper ejector 300 may be moved up and down in conjunction with the pivoting motion of the lower support 270 via the link 356.

Hereinafter, the upper assembly 110 and the lower assembly 200 will be described in more detail.

The upper assembly 110 may include an upper tray 150 that defines an upper portion of each ice chamber 111 for ice formation. Further, the upper assembly 110 may further include an upper casing 120 and an upper support 170 to fix the position of the upper tray 150.

In one example, the upper casing 120 may have a horizontal extension 142 and a vertical extension 140. The horizontal extension 142 may define a top face of the upper casing 120.

The vertical extension 140 may be present inwardly of the horizontal extension 142 and may extend vertically upwards along the perimeter of the upper plate 121. The vertical extension 140 may be combined with the top face of the freezing compartment.

Further, the upper casing 120 may include a side wall 143. The side wall 143 may extend downwards from the horizontal extension 142. The side wall 143 may surround at least a portion of the circumference of the lower assembly 200. In other words, the side wall 143 prevents the lower assembly 200 from being exposed to the outside.

Further, the lower assembly 200 may be pivotally mounted in a space defined by the side wall 143 of the upper casing 120.

Further, the side wall 143 may have a cold-air hole 134 defined therein through which the cold-air is supplied into the ice-maker 100. The cold-air hole 134 may extend in an elongate manner in the left and right direction.

A cold-air guide 145 may extend between both side ends of the cold-air hole 134. The cold-air entering the cold-air hole 134 may be directed along the cold-air guide 145 toward the tray opening 123. Further, a portion of the upper tray 150 exposed through the tray opening 123 may be directly cooled via exposure to the moving cold-air.

The upper tray 150 is positioned below the upper casing 120. An upper support 170 may be located below the upper tray 150. As such, the upper casing 120, the upper tray 150, and the upper support 170 are arranged in the vertical direction one after the other and may be fastened to each other using fasteners and thus may constitute one assembly.

Further, the ice-maker 100 may further include a temperature sensor 610 for sensing the temperature of water or ice in the ice chamber 111. The temperature sensor 610 may indirectly detect the temperature of water or ice in the ice chamber 111 by sensing the temperature of the upper tray 150.

In one example, the lower assembly 200 may include a lower tray 250 that defines the lower portion of each ice chamber 111 for ice formation. Further, the lower assembly 200 may further include a lower support 270 supporting the bottom of the lower tray 250 and a lower casing 210 covering the top of the lower tray 250.

The lower casing 210, lower tray 250, and the lower support 270 may be arranged vertically and may be fastened with each other using fasteners to form one assembly.

In one example, the ice-maker 100 may further include a switch 600 for turning the ice-maker 100 on or off.

One end of the ice-full state detection lever 700 is connected to the driver 180, while the other end of the ice-full state detection lever 700 is pivotally connected to the upper casing 120 so that the ice-full state detection lever 700 may pivot according to the operation of the driver 180.

The ice-full state detection lever 700 may include an ice-full state detector 710 that detects ice inside the ice bin 500 while being be moved inside the ice bin 500. The ice-full state detector 710 extends in a straight manner and may extend from one end to the other end of the ice bin 500. Further, both ends of the ice-full state detector 710 are bent such that one end thereof may be connected to the driver 180, while the other end may be rotatably connected to the upper casing 120.

Figure 13:
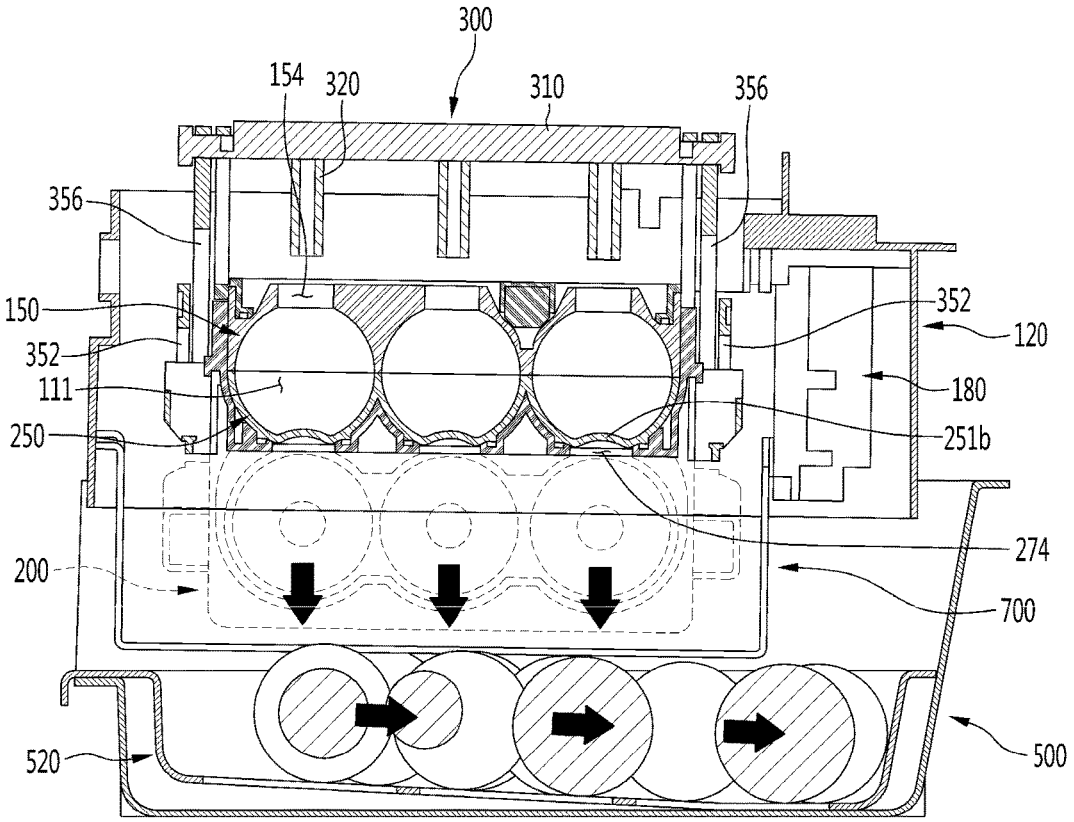
FIG. 13 shows a state in which spherical ices are removed from the ice-maker and distributed inside the ice bin.
Figure 14:
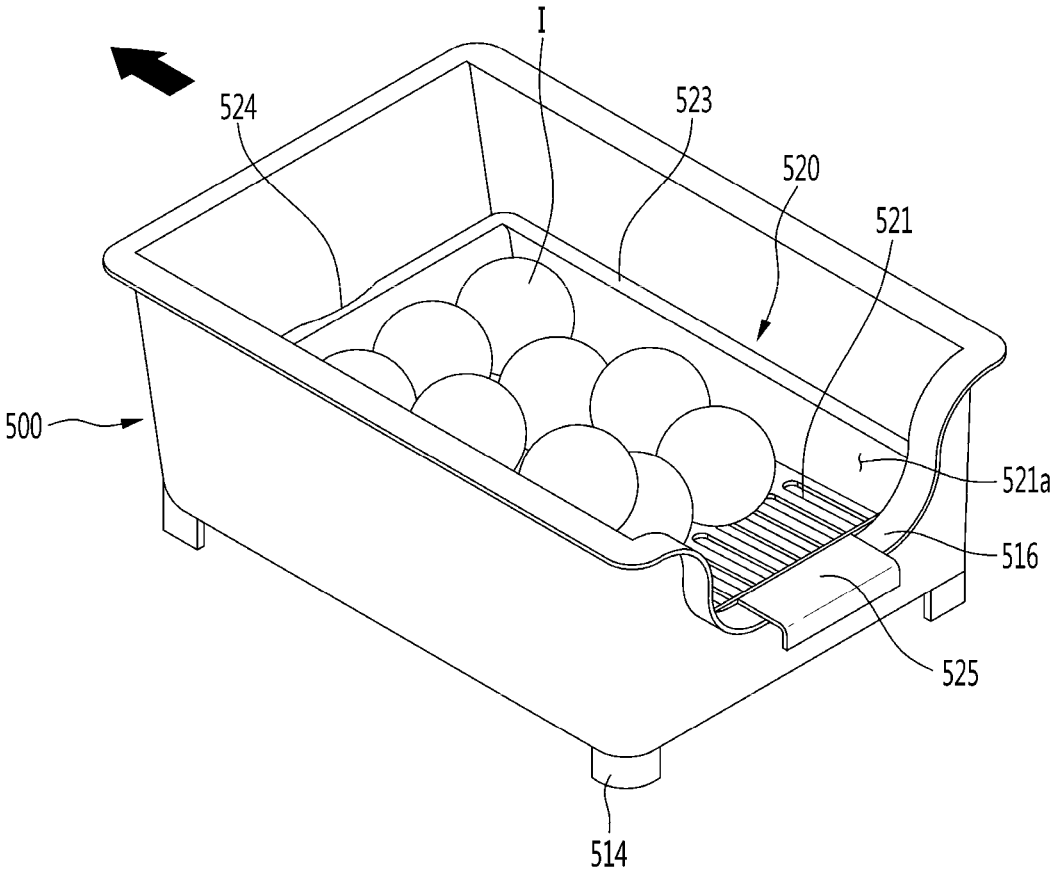
FIG. 14 is a perspective view of a state in which the ices are distributed inside the ice bin.

FIG. 13 shows a state in which spherical ices are removed from the ice-maker and are arranged inside the ice bin. Further, FIG. 14 shows a perspective view of a state in which the ices are arranged inside the ice bin.

Referring to the drawings, the water supplied from the water supply 190 is fed to each ice chamber for ice-making through an inlet 154 formed in the upper tray 150 of the ice tray 520. Water introduced through one of the plurality of inlets 154 transfers from a corresponding ice chamber to a neighboring ice chamber 111. After the water has been filled up to a set height, the lower tray 250 will pivot in a forward direction to close each chamber defined by the upper tray 150 and lower tray 250 completely.

In this state, the cold-air supplied from the evaporator inside the freezing compartment 4 is supplied to the ice-maker 100 to cool the water inside the ice chamber 111. In detail, the cold-air passing through the cold-air hole 134 along the cold-air guide 145 may be concentrated on the top face of the upper casing 120.

When it is detected that the water inside the ice chamber 111 is completely frozen to complete the spherical ice, using the temperature sensor 610, the lower tray 250 will again pivot in the reverse direction. The ice chamber 111 may be open as the lower tray 250 pivots in the reverse direction. Further, in conjunction with the pivoting of the lower tray 250, the pivoting arm 352 pivots to move the upper ejector 300 downwards. The ejecting pin 320 of the upper ejector 300 passes through the inlet 154 to push the spherical ice I located in the upper portion of the ice chamber 111 downwards for the ice-removal.

In one example, when the lower tray 250 is further pivoted and then fully pivoted in the reverse direction, the lower ejecting rod 420 of the lower ejector 400 penetrates through the lower tray opening 274 and presses a convex portion 251*b* of the bottom face of the lower tray 250. That is, the lower ejector 400 presses the lower tray 250 made of an elastic material such as silicone so that the spherical ice I located in the lower chamber 250 may be removed out of the lower tray 250.

The spherical ice I removed from the ice-maker 100 falls downwards and may fall to the bottom 521 of the ice tray 520 mounted in the ice bin 500. Further, the spherical ice I dropped onto the ice tray 520 rolls forwards along the slope of the bottom face of the ice tray 520.

Further, ice debris generated during the ice-removal process of the ice-maker 100 or during the process of moving the spherical ice may be separated and stored through the tray holes 521*a* onto the bottom face of the ice bin 500. That is, only the spherical ice may be disposed onto the ice tray 520 while being separated from the ice debris.

As the ice-making and ice-removal process are repeated in the ice-maker 100, the removed spherical ices I may be arranged sequentially from the front end of the ice tray 520. As shown in FIG. 14, the spherical ices I may be concentrated in a front half of the ice bin 500.

In this state, when the user intends to use the spherical ices I, the freezing compartment drawer 41 is extended to expose the ice bin 500. In this connection, since the spherical ices I have first filled the front half of the ice bin 500, the freezing compartment drawer 41 does not need to be fully extended. Thus, when the user withdraws the drawer to an extent that the front half of the ice bin 500 is visible to the user, the user may take out the ice.

Therefore, the cold-air leakage inside the freezing compartment 4 may be minimized, and at the same time, the ice in the ice bin 500 may be taken out with minimal user manipulation. Further, when the user has taken the ice out of the ice bin 500, the spherical ices I inside the ice tray 520 may be moved forwards along the slope of the bottom face by the taken amount thereof and may fill the front half of the ice bin 500 again.

The spherical ice I removed from the ice tray 520 may roll forwards in the ice tray 520. In this process, the ice contacts the neighboring spherical ice I or ice tray 520 such that a burr around the spherical ice I may be removed. Thus, the spherical ice I may be in a more spherical state. Ice debris caused by the burr removal may be discharged to the bottom face of the ice bin 500 through the tray holes 512*a*.

In one example, even when the freezing compartment drawer 41 or the ice bin 500 is withdrawn out, the spherical ice I inside the ice bin 500 fills the front half of the ice bin 500 due to the inclination of the bottom face of the ice tray 520. Even when small movement of the freezing compartment drawer 41 and ice bin 500 may occur, the spherical ice I will not excessively move or deviate from a position.

As described above, the present disclosure is described with reference to the drawings. However, the present disclosure is not limited by the embodiments and drawings disclosed in the present specification. It will be apparent that various modifications may be made thereto by those skilled in the art within the scope of the present disclosure. Furthermore, although the effect resulting from the features of the present disclosure has not been explicitly described in the description of the embodiments of the present disclosure, it is obvious that a predictable effect resulting from the features of the present disclosure should be recognized.

What is claimed is:

1. A refrigerator comprising:

a cabinet that defines a freezing compartment therein;

an ice maker disposed in the freezing compartment and configured to make one or more ice pieces having a spherical shape, the ice maker being configured to release the one or more ice pieces in a downward direction;

an ice bin disposed vertically below the ice maker and configured to store the one or more ice pieces released from the ice maker; and an ice tray configured to be disposed inside the ice bin, wherein the ice tray comprises:

a bottom surface that is configured to receive the one or more ice pieces, that is spaced apart from a bottom surface of the ice bin, and that defines a plurality of tray holes that passes through the bottom surface of the ice tray, a front portion that extends upward from a front end of the bottom surface of the ice tray, a rear portion that extends upward from a rear end of the bottom surface of the ice tray, and lateral portions that respectively extend upwardly from lateral ends of the bottom surface of the ice tray and that connect the front portion and the rear portion to each other, wherein a height of the front portion from the bottom surface of the ice tray is greater than a height of the rear portion from the bottom surface of the ice tray, and wherein the bottom surface of the ice tray is inclined with respect to the bottom surface of the ice bin.

2. The refrigerator of claim 1, wherein the ice bin is configured to be withdrawn from the freezing compartment in a front direction, wherein the bottom surface of the ice tray is inclined with respect to the bottom surface of the ice bin, and wherein a vertical level of a front end of the bottom surface of the ice tray is lower than a vertical level of a rear end of the bottom surface of the ice tray with respect to the bottom surface of the ice bin.

3. The refrigerator of claim 1, further comprising:

a drawer disposed vertically below the ice maker and configured to be inserted into and withdrawn from the freezing compartment, wherein the ice bin is configured to be mounted inside the drawer and move together with the drawer.

4. The refrigerator of claim 3, wherein the drawer defines a bin mounting guide on a bottom surface of the drawer facing the ice maker, the bin mounting guide defining a mounting position of the ice bin.

5. The refrigerator of claim 4, wherein the bin mounting guide protrudes from the bottom surface of the drawer and is configured to restrict movement of a side wall of the ice bin.

6. The refrigerator of claim 4, wherein the ice bin comprises a plurality of legs that respectively extend downward from four corners of the ice bin, and wherein the bin mounting guide is configured to contact an outer surface of each of the plurality of legs to thereby restrict movement of the ice bin.

7. The refrigerator of claim 3, wherein the bottom surface of the ice tray is inclined with respect to the bottom surface of the ice bin, and wherein a vertical level of the bottom surface of the ice tray with respect to the bottom surface of the ice bin increases in a direction in which the drawer inserts into the freezing compartment.

8. The refrigerator of claim 1, wherein a width of each of the plurality of tray holes is less than a size of each ice piece, and wherein the plurality of the tray holes are defined in an entire area of the bottom surface of the ice tray.

9. The refrigerator of claim 1, wherein the ice bin defines:

a top opening disposed at a top surface of the ice bin, the top opening being configured to receive at least a portion of the ice maker therein; and a bin opening disposed at a rear surface of the ice bin and recessed from the top surface of the ice bin, and wherein a bottom end of the bin opening is disposed vertically below a bottom end of the ice maker.

10. The refrigerator of claim 9, further comprising a cover plate that extends downward from the ice maker and that covers at least a portion of the bin opening.

11. The refrigerator of claim 9, wherein the ice tray comprises a handle that protrudes outward relative to the bin opening and that is configured to receive a portion of the ice bin that defines the bin opening.

12. The refrigerator of claim 11, wherein the ice tray defines a handle groove that is disposed at one end of the ice tray and that is disposed at an opposite side of the handle, and wherein the handle groove is spaced apart from an inner wall surface of the ice bin.

13. The refrigerator of claim 1, wherein a distance between the bottom surface of the ice tray and the bottom surface of the ice bin increases as the ice tray extends in a rearward direction to an inside of the freezing compartment.

14. The refrigerator of claim 13, wherein a front end of the bottom surface of the ice tray is configured to contact the ice bin and to be supported by the ice bin.

15. The refrigerator of claim 1, wherein the ice tray comprises a handle that extends rearward from the rear portion of the ice tray and that is configured to be seated on an end of the ice bin.

16. The refrigerator of claim 15, wherein the handle comprises:

a first extension that extends rearward from a top end of the rear portion; and a second extension that extends downward from a distal end of the first extension.

17. The refrigerator of claim 16, wherein the ice bin defines a bin opening that is disposed at a rear surface of the ice bin and that is recessed from a top surface of the ice bin, and wherein the first extension is configured to be received in the bin opening, and the second extension is configured to be exposed to an outside of the bin opening.

18. The refrigerator of claim 1, wherein the ice tray comprises a rim that extends along a perimeter of a top end of the ice tray and that is bent outward from the top end of the ice tray, and wherein at least a portion of the rim is configured to contact an inner surface of the ice bin.

19. The refrigerator of claim 18, wherein the ice tray defines a handle groove that is recessed from an outer portion of the rim and that defines a space between the rim and the ice bin.

* * * * *